US010309609B2

(12) United States Patent
Hatanaka et al.

(10) Patent No.: US 10,309,609 B2
(45) Date of Patent: Jun. 4, 2019

(54) LIGHTING DEVICE FOR VEHICLE AND LIGHTING TOOL FOR VEHICLE

(71) Applicant: Toshiba Lighting & Technology Corporation, Yokosuka-shi, Kanagawa-ken (JP)

(72) Inventors: Toshihiro Hatanaka, Yokosuka (JP); Ryuji Tsuchiya, Yokosuka (JP); Daisuke Kosugi, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 15/672,985

(22) Filed: Aug. 9, 2017

(65) Prior Publication Data

US 2018/0051858 A1 Feb. 22, 2018

(30) Foreign Application Priority Data

Aug. 19, 2016 (JP) ..... 2016-161314

(51) Int. Cl.

| | |
|---|---|
| ***F21S 43/19*** | (2018.01) |
| ***F21V 29/76*** | (2015.01) |
| ***F21S 43/14*** | (2018.01) |
| ***F21S 45/47*** | (2018.01) |
| ***H05B 33/08*** | (2006.01) |
| ***F21S 45/10*** | (2018.01) |

(Continued)

(52) U.S. Cl.

CPC ..... *F21S 43/195* (2018.01); *F21S 43/14* (2018.01); *F21S 45/10* (2018.01); *F21S 45/47* (2018.01);

(Continued)

(58) Field of Classification Search

CPC ..... F21S 43/195; F21S 45/10; F21S 45/47; F21S 43/14; F21S 41/143; F21S 41/194;

(Continued)

(56) References Cited

U.S. PATENT DOCUMENTS

2008/0117647 A1* 5/2008 Behr ..... F21V 29/004 362/547
2009/0296418 A1* 12/2009 Luo ..... F21K 9/00 362/516

(Continued)

FOREIGN PATENT DOCUMENTS

EP 2899455 A2 7/2015
JP 2012-119243 A 6/2012

(Continued)

OTHER PUBLICATIONS

Jan. 4, 2018—(EP) Extended Search Report—App 17185674.3.

*Primary Examiner* — Kevin Quarterman
(74) *Attorney, Agent, or Firm* — Banner & Witcoff, Ltd.

(57) ABSTRACT

A lighting device for a vehicle includes a plate-shaped flange; a placing portion provided on a first face of the flange; a light emitting module provided at an end face of the placing portion, and which includes a light emitting element; and a plurality of heat radiating fins formed in a plate shape, and which is provided on a second face of the flange on a side opposite to the first face. Also, the device includes a plurality of first protrusion portions provided on the second face of the flange in a line, in a direction intersecting a direction in which the plurality of heat radiating fins are aligned; and a second protrusion portion which is provided on the second face of the flange on a side opposite to the plurality of first protrusion portions, by interposing the plurality of heat radiating fins therebetween.

17 Claims, 4 Drawing Sheets

(51) Int. Cl.
*F21Y 115/10* (2016.01)
*F21S 41/19* (2018.01)
*F21S 41/143* (2018.01)

(52) U.S. Cl.
CPC ..... *F21V 29/76* (2015.01); *H05B 33/0803* (2013.01); *F21S 41/143* (2018.01); *F21S 41/192* (2018.01); *F21S 41/194* (2018.01); *F21Y 2115/10* (2016.08)

(58) Field of Classification Search
CPC .... F21S 41/192; F21V 29/76; H05B 33/0803; F21Y 2115/10
See application file for complete search history.

(56) References Cited

U.S. PATENT DOCUMENTS

2010/0128479 A1 5/2010 Biebl et al.
2011/0058387 A1* 3/2011 Matsunaga ..... F21K 9/00 362/547
2012/0307501 A1* 12/2012 Tankala ..... F21K 9/90 362/294
2013/0258672 A1* 10/2013 Bell ..... F21V 13/04 362/294
2015/0016136 A1 1/2015 Nakano et al.
2015/0211725 A1* 7/2015 Ikuta ..... F21S 41/192 362/382
2017/0023201 A1 1/2017 Hino et al.

FOREIGN PATENT DOCUMENTS

JP 2013-247062 A 12/2013
JP 2013-247093 A 12/2013
JP 2016-106351 A 6/2016
JP 2016-106352 A 6/2016
WO 2008/119392 A1 10/2008
WO 2013/153938 A1 10/2013

* cited by examiner

LIGHTING DEVICE FOR VEHICLE AND LIGHTING TOOL FOR VEHICLE

CROSS-REFERENCE TO RELATED APPLICATIONS

This application is based upon and claims the benefit of priority from Japanese Patent Application No. 2016-161314, filed on Aug. 19, 2016; the entire contents of which are incorporated herein by reference.

FIELD

Embodiments described herein relate generally to a lighting device for vehicle, and a lighting tool for vehicle.

BACKGROUND

There is a lighting device for vehicle which includes a socket, and a light emitting module which is provided on one end face of the socket, and includes a light emitting diode (LED).

Heat generated in the light emitting diode is mainly radiated to the outside through the socket.

For this reason, a plurality of thin plate-shaped heat radiating fins are provided in the socket.

In addition, the heat radiating fin is provided on a side of the socket opposite to a side on which the light emitting module is provided.

Here, when the lighting device for vehicle is mounted on a lighting tool for vehicle, an end portion of the socket on the side on which the light emitting module is provided is inserted into a hole provided in the lighting tool for vehicle, the lighting device for vehicle is rotated, and is held in the lighting tool for vehicle. Such a mounting method is referred to as twist-lock. When the lighting device for vehicle is mounted on the lighting tool for vehicle, a worker grips a side of the socket opposite to the side on which the light emitting module is provided. In this case, since the heat radiating fin is provided on the side of the socket opposite to the side on which the light emitting module is provided, the worker grips the heat radiating fin.

Here, in the lighting device for vehicle, the number of heat radiating fins provided in a predetermined region is increased, by making a thickness of the heat radiating fin small. However, since a worker grips the heat radiating fin when mounting the lighting device for vehicle, there is a concern that the thin plate-shaped heat radiating fin may be damaged. In recent years, a socket formed of a high heat conductive resin is proposed in order to make the lighting device for vehicle lightweight. However, there is a problem in that intensity of a high heat conductive resin into which filler is mixed decreases. For this reason, when adopting a socket formed of a high heat conductive resin, damage of the heat radiating fin more easily occurs when a worker grips the heat radiating fin.

Therefore, there is a desire for a development of a technology in which it is possible to suppress damage of a heat radiating member, and improve a heat radiating property.

DETAILED DESCRIPTION

Figure 1:
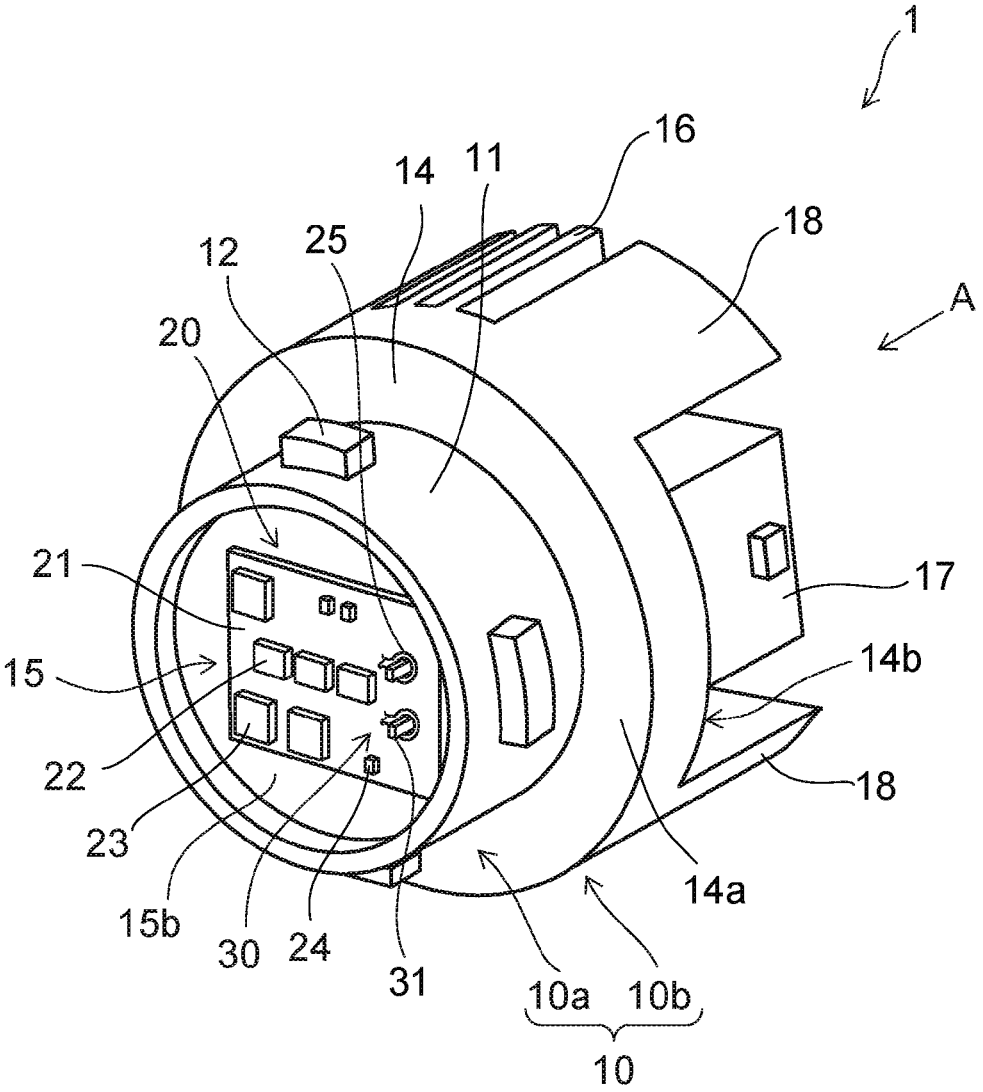
FIG. 1 is a schematic perspective view which exemplifies a lighting device for vehicle according to an embodiment.

A lighting device for vehicle according to one embodiment includes a plate-shaped flange; a placing portion which is provided on a first face of the flange; a light emitting module which is provided at an end face of the placing portion, and includes a light emitting element; a plurality of heat radiating fins which are formed in a plate shape, and provided on a second face of the flange on a side opposite to the first face; a plurality of first protrusion portions which are provided on the second face of the flange in a line, in a direction intersecting a direction in which the plurality of heat radiating fins are aligned; and a second protrusion portion which is provided on the second face of the flange on a side opposite to the plurality of first protrusion portions, by interposing the plurality of heat radiating fins therebetween.

Hereinafter, the embodiment will be exemplified with reference to drawings. In addition, in each figure, the same reference numerals are attached to the same constituent elements, and detailed descriptions thereof will be appropriately omitted.

Lighting Device for Vehicle

A lighting device for vehicle 1 according to the embodiment can be provided in a vehicle, a railway vehicle, or the like, for example. As the lighting device for vehicle 1 provided in a vehicle, for example, it is possible to exemplify a device which is used in a front combination light (for example, light in which daytime running lamp (DRL), position lamp, turn signal lamp, and the like, are appropriately combined), a rear combination light (for example, stop lamp, tail lamp, turn signal lamp, back lamp, fog lamp, and the like, are appropriately combined), or the like. However, a use of the lighting device for vehicle 1 is not limited to these.

FIG. 1 is a schematic perspective view for exemplifying the lighting device for vehicle 1 according to the embodiment.

Figure 2:
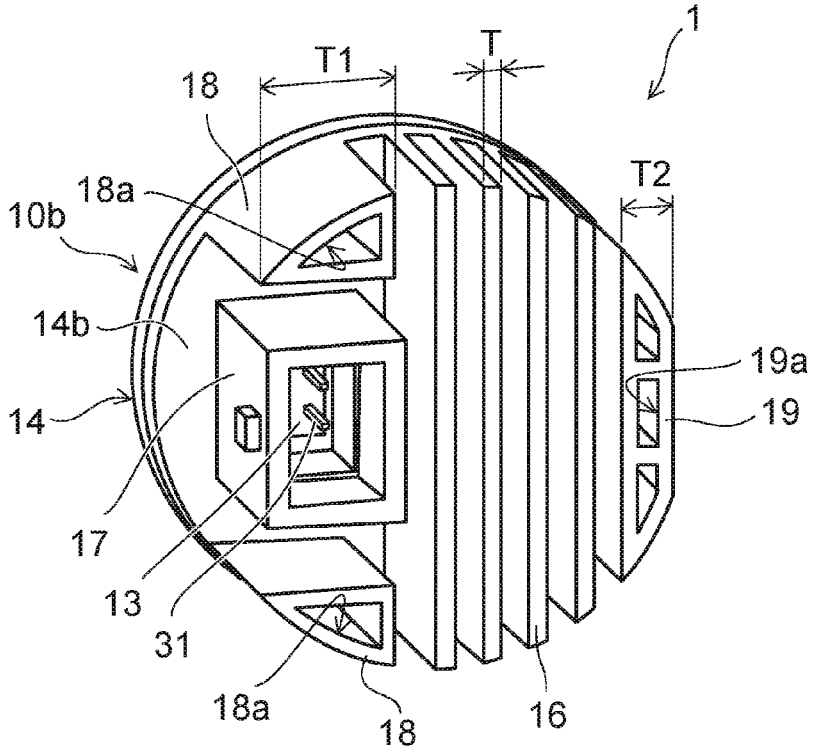
FIG. 2 is a schematic view in which the lighting device for vehicle is viewed in a direction A in FIG. 1.

FIG. 2 is a perspective view in which the lighting device for vehicle 1 is viewed in a direction A in FIG. 1.

As illustrated in FIGS. 1 and 2, a socket 10, a light emitting module 20, and a power feeding unit 30 are provided in the lighting device for vehicle 1.

The socket 10 includes a receiving portion 10*a* and a heat radiating portion 10*b*.

The receiving portion 10*a* includes a mounting unit 11, a bayonet 12, and an insulating portion 13.

The mounting unit 11 is formed in a tubular shape. The mounting unit 11 can be set to a cylindrical shape, for example. The mounting unit 11 is provided on a face 14*a* (corresponding to an example of first face) of a flange 14 on a side opposite to a face 14*b* (corresponding to an example of second face) on which a heat radiating fin 16 is provided. The mounting unit 11 surrounds a placing portion 15.

The bayonet 12 is provided on a side face of the mounting unit 11, and protrudes toward the outside of the lighting device for vehicle 1. The bayonet 12 faces the flange 14. A plurality of the bayonets 12 are provided. The bayonet 12 is used when attaching the lighting device for vehicle 1 to a lighting tool for vehicle 100 using twist-lock.

The insulating portion 13 is provided inside the mounting unit 11.

The receiving portion 10*a* can be formed by integrally molding the mounting unit 11, the bayonet 12, and the insulating portion 13, or can be formed by bonding thereof.

The receiving portion 10*a* has a function of receiving the light emitting module 20, and a function of insulating a power feeding terminal 31. For this reason, it is preferable to form the mounting unit 11, the bayonet 12, and the insulating portion 13 using an insulating material. The insulating material can be set to an organic material such as a resin, for example, or an inorganic material such as ceramic (for example, aluminum oxide, or aluminum nitride), or the like.

The heat radiating portion 10*b* includes the flange 14, the placing portion 15, the heat radiating fin 16, a terminal cover 17, a protrusion portion 18 (corresponding to an example of first protrusion portion), and a protrusion portion 19 (corresponding to an example of second protrusion portion).

The flange 14 is formed in a plate shape. The flange 14 can be set to a flange formed in a disk shape, for example. An outer face of the flange 14 is located in the outside of the lighting device for vehicle 1, rather than the outer face of the bayonet 12.

The placing portion 15 can be set to a columnar shape. The placing portion 15 is provided on the face 14*a* of the flange 14 on a side opposite to the face 14*b* on which the heat radiating fin 16 is provided. A recessed portion is provided on a side face of the placing portion 15. The insulating portion 13 is provided inside the recessed portion. The light emitting module 20 (substrate 21) including a light emitting element 22 is provided on an end face 15*b* of the placing portion 15.

In addition, it is possible to provide a layer, or the like, formed of a metal substrate (not illustrated), heat conductive grease, or an adhesive between a face of the light emitting module 20 (substrate 21) on a side opposite to a side on which the light emitting element 22 is provided and the end face 15*b* of the placing portion 15, in order to increase a heat radiating property.

The heat radiating fin 16 is provided on the face 14*b* of the flange 14 on a side opposite to the face 14*a*. A plurality of the heat radiating fins 16 are provided. The plurality of heat radiating fins 16 can be provided so as to be parallel to each other. The heat radiating fin 16 can be set to a flat-plate shape.

The terminal cover 17 has a function of protecting an end portion of the power feeding terminal 31, and a function of holding a connector 105. The terminal cover 17 is provided on the face 14*b* of the flange 14. The insulating portion 13 in which the power feeding terminal 31 is provided is provided at a position deviated from a peripheral edge of the flange 14 toward a center side. For this reason, the terminal cover 17 is also provided at a position deviated from the peripheral edge of the flange 14 toward the center side. The terminal cover 17 can be set to a rectangular tubular shape, for example. An end portion of the power feeding terminal 31 protrudes in the terminal cover 17. The connector 105 including a sealing member is mounted on the terminal cover 17.

The protrusion portions 18 and 19 are provided on the face 14*b* of the flange 14. The protrusion portions 18 and 19 will be described later in detail.

A heat radiating portion 10*b* can be formed by integrally molding the flange 14, the placing portion 15, the heat radiating fin 16, the terminal cover 17, and the protrusion portions 18 and 19, or it is also possible to bond these elements, by separately forming thereof.

The heat radiating portion 10*b* has a function of placing the light emitting module 20, and a function of radiating heat generated in the light emitting module 20 to the outside. For this reason, it is preferable to form the heat radiating portion 10*b* using a material with high heat conductivity by taking the function of radiating heat into consideration. It is possible to set the material with high heat conductivity to, for example, metal such as aluminum, or an aluminum alloy, ceramic such as aluminum oxide, or aluminum nitride, a high heat conductive resin, or the like. The high heat conductive resin is obtained by mixing filler formed of aluminum oxide with high heat conductivity, or carbon into a resin such as polyethylene terephthalate (PET), or nylon, for example.

The heat radiating portion 10*b* is bonded to the receiving portion 10*a*. The receiving portion 10*a* and the heat radiating portion 10*b* may be fitted to each other, may be bonded using an adhesive, or the like, may be integrally molded using an insert molding method, or, may be bonded using heat welding.

In addition, it is also possible to integrally mold the receiving portion 10*a* and the heat radiating portion 10*b*. For example, it is also possible to set the socket 10 (receiving portion 10*a* and heat radiating portion 10*b*) to be integrally molded using a high heat conductive resin, or the like. In this case, when forming at least any one of the receiving portion 10*a* and the heat radiating portion 10*b* using a high heat conductive resin, it is possible to obtain a lighting device for vehicle 1 which is lightweight, and of which a heat radiating property is improved.

The light emitting module 20 is provided on the end face 15*b* of the placing portion 15.

The light emitting module 20 includes the substrate 21, the light emitting element 22, a resistor 23, and a diode 24.

The substrate 21 is provided on the face 15*b* of the placing portion 15. The substrate 21 is formed in a flat-plate shape. A wiring pattern 25 is provided on the surface of the substrate 21. A material or a structure of the substrate 21 is not particularly limited. For example, the substrate 21 can be formed of an inorganic material such as ceramic (aluminum oxide, aluminum nitride, or the like), an organic material such as paper phenol, glass epoxy, or the like. In addition, the substrate 21 may be a substrate obtained by covering the surface of metal with an insulating material. The substrate 21 may be a single layer, or a multiple layer.

The light emitting element 22 is provided on the substrate 21. The light emitting element 22 is electrically connected to the wiring pattern 25 which is provided on the surface of the substrate 21. The light emitting element 22 can be set to, for example, a light emitting diode, an organic light emitting diode, a laser diode, or the like.

A form of the light emitting element 22 is not particularly limited.

The light emitting element 22 can be set to a surface mounting-type light emitting element such as a plastic leaded chip carrier (PLCC) type. The light emitting element 22 exemplified in FIG. 1 is the surface mounting-type light emitting element.

The light emitting element 22 can also be set to a light emitting element including a lead wire of a cannonball type, or the like.

The light emitting element 22 can also be set to an element which is mounted using a chip on board (COB). When it is set to the light emitting element 22 which is mounted, using the COB, a chip-shaped light emitting element 22, wiring which electrically connects the light emitting element 22 and the wiring pattern 25, a frame-shaped member which surrounds the light emitting element 22 and the wiring, a sealing portion which is provided inside the frame-shaped member, and the like, can be provided on the substrate 21. In this case, a phosphor can be contained in the sealing portion. The phosphor can be set to an yttrium-aluminum-garnet-based phosphor (YAG), for example. However, a type of the phosphor is not particularly limited to the example, and can be appropriately changed so as to obtain a desired luminescent color according to a use of the lighting device for vehicle 1, or the like.

The resistor 23 is provided on the substrate 21. The resistor 23 is electrically connected to the wiring pattern 25 provided on the surface of the substrate 21. The resistor 23 controls a current which flows in the light emitting element 22.

Since there is unevenness in forward voltage characteristics of the light emitting element 22, when setting an application voltage between an anode terminal and a ground terminal to be constant, there is unevenness in brightness (light flux, luminance, intensity of light, illuminance) of the light emitting element 22. For this reason, it is set so that a value of current which flows in the light emitting element 22 falls in a predetermined range using the resistor 23, in order for the brightness of the light emitting element 22 to fall in a predetermined range. In this case, it can be set so that a value of current which flows in the light emitting element 22 falls in a predetermined range, by changing a resistance value of the resistor 23.

The resistor 23 can be set to a surface mounting-type resistor, a resistor with a lead wire (metal oxide film resistor), a film-shaped resistor, or the like, which is formed, using a screen printing method, or the like. The resistor 23 exemplified in FIG. 1 is a film-shaped resistor. The number, a size, an arrangement, and the like, of the resistor 23 are not limited to the example, and can be appropriately changed according to the number, a specification, or the like, of the light emitting element 22.

The diode 24 is provided on the substrate 21. The diode 24 is electrically connected to the wiring pattern 25 which is provided on the surface of the substrate 21. The diode 24 can be set to, for example, a surface mounting-type diode, a diode including a lead wire, or the like. The diode 24 exemplified in FIG. 1 is the surface mounting-type diode. The diode 24 can be provided on an input side of the light emitting module 20. The diode 24 is provided so as to cause a backward voltage is not applied to the light emitting element 22, and cause a pulse noise from a reverse direction is not applied to the light emitting element 22.

In addition to that, it is also possible to provide a covering portion which covers the wiring pattern 25 or the film-shaped resistor. The covering portion can be set to a portion containing a glass material, for example. In addition, it is also possible to provide a pull-down resistor in order to detect disconnection of the light emitting element 22, prevent erroneous lighting, or the like.

The power feeding unit 30 includes a plurality of power feeding terminals 31. The plurality of power feeding terminals 31 are provided inside the socket 10 (insulating portion 13). One end portion of the plurality of power feeding terminals 31 protrudes from an end face of the insulating portion 13 on a side opposite to the flange 14 side, and is electrically connected to the wiring pattern 25 provided on the substrate 21. The other end portion of the plurality of power feeding terminals 31 protrudes from the end face of the insulating portion 13 on the flange 14 side. The other end portion of the plurality of power feeding terminals 31 is exposed to the inside of the terminal cover 17. In addition, the number, a shape, or the like, of the power feeding terminal 31 is not limited to the example, and can be appropriately changed.

Subsequently, the protrusion portions 18 and 19 will be further described later.

The protrusion portion 18 can be set to a block shaped. By setting to the protrusion portion 18 formed in a block shape, rigidity of the protrusion portion 18 becomes higher than that of the heat radiating fin 16. The protrusion portion 18 protrudes from the face 14*b* of the flange 14. The protrusion portion 18 is provided in the vicinity of the peripheral edge of the flange 14. A plurality of the protrusion portions 18 can be provided. In a case of the example illustrated in FIG. 2, two protrusion portions 18 are provided. The terminal cover 17 is provided between the plurality of protrusion portions 18. The plurality of protrusion portions 18 and the terminal cover 17 can be provided in a line, in a direction intersecting a direction in which the plurality of heat radiating fins 16 are aligned. A distance from the face 14*b* of the flange 14 to an end face of the protrusion portion 18 can be set to be approximately the same as the distance from the face 14*b* of the flange 14 to an end face of the terminal cover 17.

Here, since the connector 105 is mounted on the terminal cover 17, it is difficult to make an external dimension (wall thickness dimension) of the terminal cover 17 large. For this reason, there is a case in which resistance of the terminal cover 17 to an external force decreases. In the lighting device for vehicle 1 according to the embodiment, the terminal cover 17 is provided between the plurality of protrusion portions 18. In addition, the plurality of protrusion portions 18 are provided in the vicinity of the peripheral edge of the flange 14, and the terminal cover 17 is provided at a position deviated from the peripheral edge of the flange 14 toward the center side. For this reason, it is possible to suppress an addition of an external force to the terminal cover 17.

The protrusion portion 19 can be set to a block shape. By setting the protrusion portion 19 to the block shape, rigidity of the protrusion portion 19 increases compared to that of the heat radiating fin 16. The protrusion portion 19 protrudes from the face 14*b* of the flange 14. The protrusion portion 19 is provided in the vicinity of the peripheral edge of the flange 14. The protrusion portion 19 is provided on a side opposite to the plurality of protrusion portions 18 by interposing the plurality of heat radiating fins 16 therebetween. For this reason, both sides of the columns of the plurality of heat radiating fins 16 are surrounded with the plurality of protrusion portions 18 and the protrusion portion 19.

A distance from the face 14*b* of the flange 14 to an end face of the protrusion portion 19 can be set to be approximately the same as a distance from the face 14*b* of the flange 14 to an end face of the plurality of heat radiating fins 16.

In addition, a distance from the face 14*b* of the flange 14 to an end face of the protrusion portion 18 can be set to be approximately the same as a distance from the face 14*b* of the flange 14 to the end face of the plurality of heat radiating fins 16.

Here, when making the thickness of the plurality of heat radiating fins 16 small, it is possible to increase the number of heat radiating fins 16 which are provided in a predetermined region. When it is possible to increase the number of heat radiating fins 16, it is possible to make a heat radiating area large. For this reason, the thickness of the heat radiating fins 16 becomes small, in general. When making the thickness of the heat radiating fin 16 small, resistance of the heat radiating fin 16 to an external force decrease. In the lighting device for vehicle 1 according to the embodiment, both sides of the columns of the plurality of heat radiating fins 16 are surrounded with the plurality of protrusion portions 18 and the protrusion portion 19. For this reason, it is possible to suppress an addition of an external force to the plurality of heat radiating fins 16.

As will be described later, when a worker mounts the lighting device for vehicle 1 on the lighting tool for vehicle 100, the worker grips the heat radiating portion 10*b* of the lighting device for vehicle 1. In this case, the plurality of heat radiating fins 16 with low rigidity and the terminal cover 17 are provided in the heat radiating portion 10*b*. For this reason, when the worker grips the plurality of heat radiating fins 16 and the terminal cover 17, there is a concern that these may be damaged. In addition, a high heat conductive resin containing filler has lower rigidity than that of a resin, metal, or the like. For this reason, when forming the heat radiating portion 10*b* using the high heat conductive resin, the plurality of heat radiating fins 16 and the terminal cover 17 are more easily damaged.

Meanwhile, there is a little restriction related to an external dimension, a wall thickness, or the like, in the protrusion portions 18 and 19. For this reason, the protrusion portions 18 and 19 can be set so as to have high rigidity compared to the plurality of heat radiating fins 16 and the terminal cover 17. In addition, the protrusion portions 18 and 19 are provided on the peripheral edge side of the flange 14, compared to the position in which the plurality of heat radiating fins 16 and the terminal cover 17 are provided. For this reason, when the lighting device for vehicle 1 is mounted on the lighting tool for vehicle 100 by a worker, the worker can easily grip the protrusion portion 18 and the protrusion portion 19 with high rigidity. As a result, when the lighting device for vehicle 1 is mounted on the lighting tool for vehicle 100 by the worker, it is possible to prevent the plurality of heat radiating fins 16 and the terminal cover 17 from being damaged.

According to a knowledge obtained by inventors of the exemplary embodiment, it was clarified that it is not possible to improve a heat radiating property when the thickness of the plurality of heat radiating fins 16 is set to be excessively small. As described above, it is considered that an improvement of heat radiating property can be obtained, by increasing the number of heat radiating fins 16 which is provided in a predetermined region by making the thickness of the heat radiating fin 16 small, and increasing the heat radiating area. However, when making the thickness of the heat radiating fin 16 small, a sectional area of a heat transfer path becomes small, and heat resistance becomes large. When a heat resistance value becomes large, a transfer of heat to a tip end of the plurality of heat radiating fins 16 is hindered. For this reason, when making the thickness of the plurality of heat radiating fins 16 excessively small, it is not possible to obtain the improvement of the heat radiating property.

Meanwhile, since there is a little restriction relating to an external dimension, a wall thickness, or the like, in the protrusion portions 18 and 19, it is possible to make a sectional area of the heat transfer path large. For this reason, it is possible to use the protrusion portions 18 and 19 as a heat radiating member. That is, it is possible for the protrusion portions 18 and 19 to have a function of not causing an external force to be added to the plurality of heat radiating fins 16 and the terminal cover 17, and a function of radiating heat together.

For this reason, it is possible to improve the heat radiating property when the protrusion portions 18 and 19 are provided. In this case, when making the thickness of the plurality of heat radiating fins 16 large to some extents, it is possible to further improve the heat radiating property.

According to a knowledge obtained by the inventors of the exemplary embodiment, it is preferable that the following expressions be satisfied, when the thickness of the heat radiating fin 16 is set to T (mm), the thickness of the protrusion portion 18 is set to T1 (mm), and the thickness of the protrusion portion 19 is set to T2 (mm). In addition, T1 (mm) is an external dimension of the protrusion portion 18 in the thickness direction of the heat radiating fin 16. T2 (mm) is an external dimension of the protrusion portion 19 in the thickness direction of the heat radiating fin 16.

$$T1 \geqq 2 \times T$$

$$T2 \geqq 2 \times T$$

When T (mm), T1 (mm), and T2 (mm) satisfy the above described expressions, it is possible to prevent the protrusion portions 18 and 19 from being damaged when a worker grips the protrusion portions 18 and 19. In addition, it is possible to make a sectional area of the heat transfer path in the protrusion portions 18 and 19 large. For this reason, it is possible to improve a heat radiating property in the protrusion portions 18 and 19.

As illustrated in FIG. 2, it is also possible to provide a recessed portion 18*a* which is open to an end face of the protrusion portion 18 (corresponding to an example of first recessed portion), and a recessed portion 19*a* which is open to an end face of the protrusion portion 19 (corresponding to an example of second recessed portion). When the recessed portions 18*a* and 19*a* are provided, it is possible to make the lighting device for vehicle lightweight. In addition, it is possible to suppress a sink of a resin when a heat radiating area is enlarged, or the protrusion portions 18 and 19 are molded. In this case, it is also possible to set to a recessed portion 18*a* which is open to a side face of the protrusion portion 18, and a recessed portion 19*a* which is open to a side face of the protrusion portion 19. However, when setting to the recessed portion 18*a* which is open to the side faces of the protrusion portion 18, and the recessed portion 19*a* which is open to the side faces of the protrusion portion 19, there is a concern that the sectional area of the heat transfer path may become small. In addition, there is a concern that rigidity of the protrusion portions 18 and 19 may decrease. For this reason, it is preferable to set to the recessed portion 18*a* which is open to the end face of the protrusion portion 18, and the recessed portion 19*a* which is open to the end face of the protrusion portion 19. In addition, the number, the size, the depth, the arrangement, and the like, of the recessed portions 18*a* and 19*a* are not limited to the examples, and can be appropriately changed by taking the heat radiating property and the rigidity into consideration.

Figure 3:
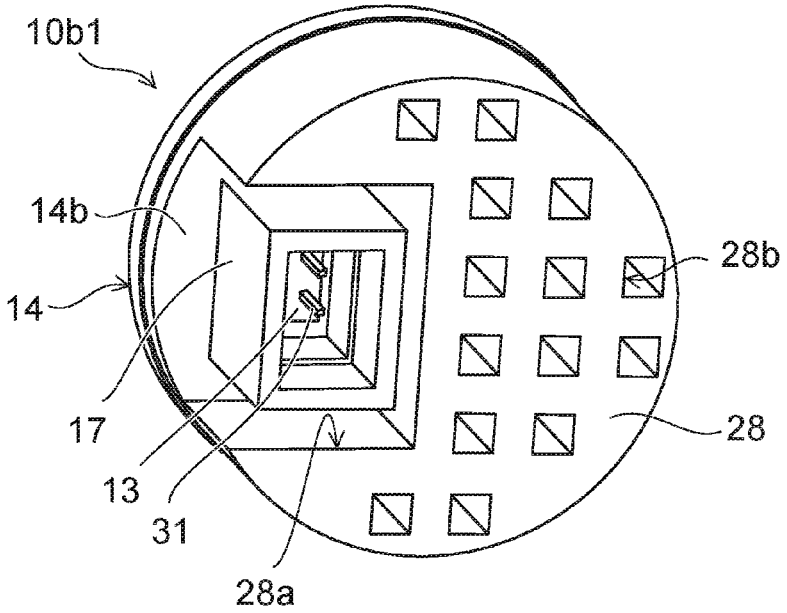
FIG. 3 is a schematic perspective view which exemplifies a heat radiating portion according to another embodiment.
Figure 4:
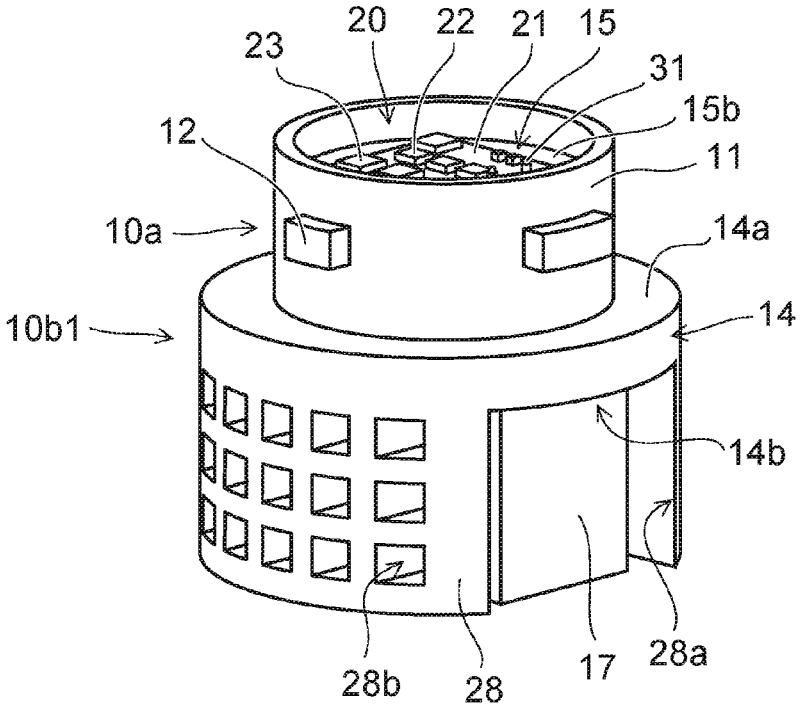
FIG. 4 is a schematic perspective view which exemplifies a heat radiating portion.
Figure 5:
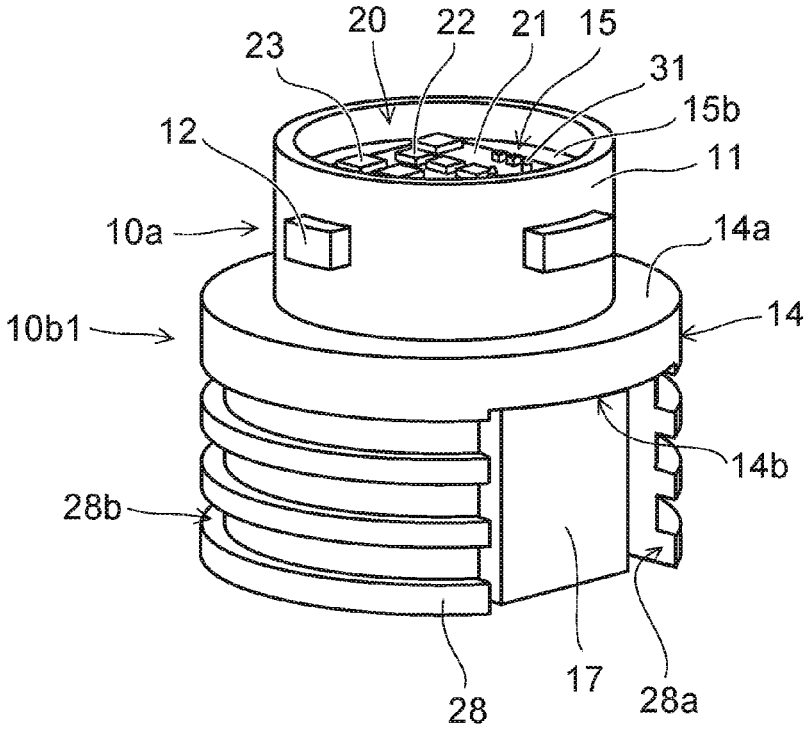
FIG. 5 is a schematic perspective view which exemplifies a heat radiating portion.

FIGS. 3 to 5 are schematic perspective views which exemplify a heat radiating portion 10*b*1 according to another embodiment.

As illustrated in FIGS. 3 to 5, the heat radiating portion 10*b*1 includes the flange 14, the placing portion 15, the terminal cover 17, and a protrusion portion 28. The heat radiating fin 16 is not provided in the heat radiating portion 10*b*1.

The protrusion portion 28 is provided on the face 14*b* of the flange 14. The protrusion portion 28 can be set to a block shape. The protrusion portion 28 protrudes from the face 14*b* of the flange 14. An external dimension of the protrusion portion 28 can be set to be appropriately the same as that of the flange 14. A recessed portion 28*a* which is open to a side face is provided in the protrusion portion 28. The terminal cover 17 is provided inside the recessed portion 28*a*. That is, the terminal cover 17 with low rigidity is surrounded with the protrusion portion 28 with high rigidity. A distance from the face 14*b* of the flange 14 to the end face of the protrusion portion 28 can be set to be approximately the same as the distance from the face 14*b* of the flange 14 to the end face of the terminal cover 17. For this reason, it is possible to prevent an external force from being added to the terminal cover 17.

The heat radiating portion 10*b*1 also can be formed by integrally molding the flange 14, the placing portion 15, the terminal cover 17, and the protrusion portion 28, or can be formed by separately forming and joining the elements. In addition, a material of the heat radiating portion 10*b*1 can be set to the same material of the heat radiating portion 10*b*.

Since the protrusion portion 28 is provided, a worker can easily grip the protrusion portion 28 with high rigidity, when the lighting device for vehicle 1 is mounted on the lighting tool for vehicle 100 by the worker. As a result, it is possible to suppress damage of the terminal cover 17 when the lighting device for vehicle 1 is mounted on the lighting tool for vehicle 100 by the worker.

Here, the heat radiating fin 16 is not provided in the heat radiating portion 10*b*1. However, when setting to the protrusion portion 28 formed in a block shape, it is possible to make the sectional area of the heat transfer path large. According to a knowledge obtained by the inventors of the exemplary embodiment, when adopting the heat radiating portion 10*b*1 provided with the protrusion portion 28 formed in a block shape, it is possible to improve a heat radiating property compared to a heat radiating portion provided only with the plurality of heat radiating fins 16.

As illustrated in FIG. 3, it is also possible to provide a recessed portion 28*b* which is open to the end face of the protrusion portion 28.

As illustrated in FIG. 4, it is also possible to provide the recessed portion 28*b* on the side face of the protrusion portion 28. In this case, the recessed portion 28*b* can be set to a through-hole. When the recessed portion is set to the through-hole, it is possible to form an air current which flows inside the protrusion portion 28. For this reason, it is possible to improve a heat radiating property.

As illustrated in FIG. 5, the recessed portion 28*b* provided on the side face of the protrusion portion 28 can be set to a groove. When the groove is provided on the side face of the protrusion portion 28, it is possible to form an air current which flows inside the groove. For this reason, it is possible to improve a heat radiating property.

When providing the recessed portion 28*b*, it is possible to make the lighting device for vehicle lightweight. In addition, it is possible to suppress a sink of a resin when enlarging the heat radiating area, or molding the protrusion portion 28. The number, a shape, a depth, an arrangement, or the like, of the recessed portion 28*b* is not limited to examples, and can be appropriately changed by taking a heat radiating property and rigidity into consideration.

When adopting the heat radiating portion 10*b*1 according to the embodiment, it is possible to suppress damage of a heat radiating member, and improve a heat radiating property.

Figure 6:
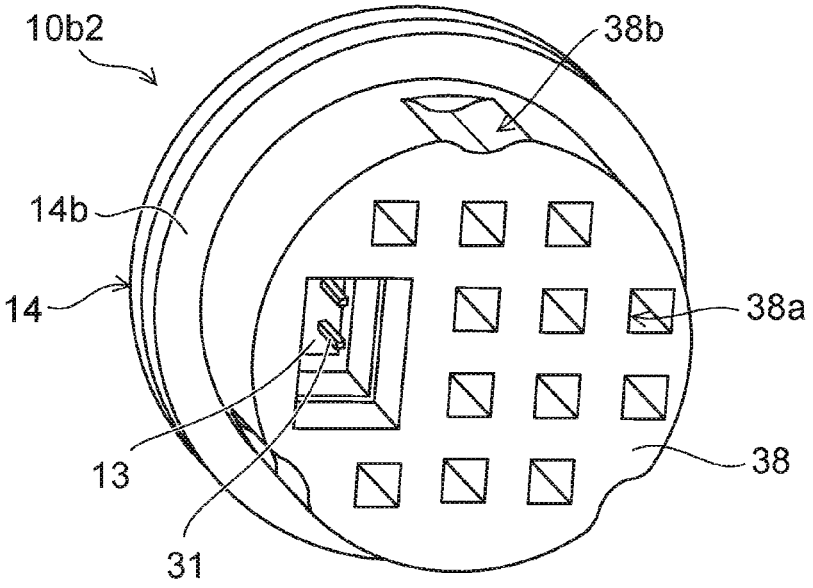
FIG. 6 is a schematic perspective view which exemplifies a heat radiating portion.

FIG. 6 is a schematic perspective view which exemplifies a heat radiating portion 10*b*2 according to another embodiment.

As illustrated in FIG. 6, the heat radiating portion 10*b*2 includes the flange 14, and a protrusion portion 38. In addition, similarly to the above described heat radiating portion 10*b*, the placing portion 15 is provided in the heat radiating portion 10*b*2. The heat radiating fin 16 is not provided in the heat radiating portion 10*b*2.

The protrusion portion 38 is provided on the face 14*b* of the flange 14. The protrusion portion 38 can be set to a block shape. The protrusion portion 38 protrudes from the face 14*b* of the flange 14. The terminal cover 17 is formed integrally with the protrusion portion 38. For this reason, a side face of the protrusion portion 38 is provided at a position in which the side face of the terminal cover 17 is provided. An external dimension of the protrusion portion 38 is set to be smaller than that of the flange 14. In addition, a distance from the face 14*b* of the flange 14 to the end face of the protrusion portion 38 can be set to be approximately the same as the distance from the face 14*b* of the flange 14 to the end face of the terminal cover 17. Since the terminal cover 17 with low rigidity and the protrusion portion 38 with high rigidity are integrally formed, it is possible to improve resistance to an external force at a portion corresponding to the terminal cover 17.

It is also possible to form the heat radiating portion 10*b*2 by integrally molding the flange 14, the placing portion 15, and the protrusion portion 38, or by separately forming and joining the elements. A material of the heat radiating portion 10*b*2 can be set to be the same as that of the heat radiating portion 10*b*.

Since the protrusion portion 38 is provided, a worker can easily grip the protrusion portion 38 with high rigidity, when mounting the lighting device for vehicle 1 on the lighting tool for vehicle 100. As a result, when the lighting device for vehicle 1 is mounted on the lighting tool for vehicle 100 by the worker, it is possible to suppress damage of a portion corresponding to the terminal cover 17.

Here, the heat radiating fin 16 is not provided in the heat radiating portion 10*b*1. However, when the protrusion portion 38 formed in a block shape is adopted, it is possible to make a sectional area of the heat transfer path large. For this reason, similarly to the above described protrusion portion 28, it is possible to improve a heat radiating property compared to a heat radiating portion provided only with the plurality of heat radiating fins 16.

In addition, it is also possible to provide a recessed portion 38*a* which is open to an end face of the protrusion portion 38. Similarly to the above described recessed portion 28*b*, it is also possible to provide the recessed portion 38*a* on a side face of the protrusion portion 38. In this case, the recessed portion 38*a* also can be set to a through-hole. When setting to the through-hole, it is possible to form an air current which flows inside the protrusion portion 38. For this reason, it is possible to improve a heat radiating property. In addition, the recessed portion 38*a* provided on the side face of the protrusion portion 38 also can be set to a groove. When the groove is provided on the side face of the protrusion portion 38, it is possible to form an air current which flows inside the groove. For this reason, it is possible to improve a heat radiating property.

When the recessed portion 38*a* is provided, it is possible to make the lighting device for vehicle lightweight. In addition, it is possible to suppress a sink of a resin when a heat radiating area is enlarged, or the protrusion portion 38 is molded. The number, a shape, a size, a depth, an arrangement, or the like, of the recessed portion 38*a* is not limited to examples, and can be appropriately changed by taking a heat radiating property and rigidity into consideration.

It is possible to provide a recessed portion 38*b* which is open to the side face and the end face of the protrusion portion 38. A plurality of the recessed portions 38*b* can be provided. The recessed portion 38*b* can be set so as to have a curved face. The shape of the recessed portion 38*b* can be set so as to be fitted to a finger of a person. When the plurality of recessed portions 38*b* are provided, it is easier for a worker to grip the protrusion portion 38. In addition, it is possible to provide the recessed portion 38*b* also in the above described protrusion portions 18 and 19, and the protrusion portion 28. The number, a shape, a size, an arrangement, and the like, of the recessed portion 38*b* are not limited to the examples, and can be appropriately changed.

According to the heat radiating portion 10*b*2 in the embodiment, it is possible to suppress damage of a heat radiating member, and to improve a heat radiating property.

Lighting Tool for Vehicle

Subsequently, the lighting tool for vehicle 100 will be exemplified.

Hereinafter, a case in which the lighting tool for vehicle 100 is a front combination light provided in a vehicle will be described, as an example. However, the lighting tool for vehicle 100 is not limited to the front combination light provided in a vehicle. The lighting tool for vehicle 100 may be a lighting tool for vehicle which is provided in a vehicle, a railway vehicle, or the like.

Figure 7:
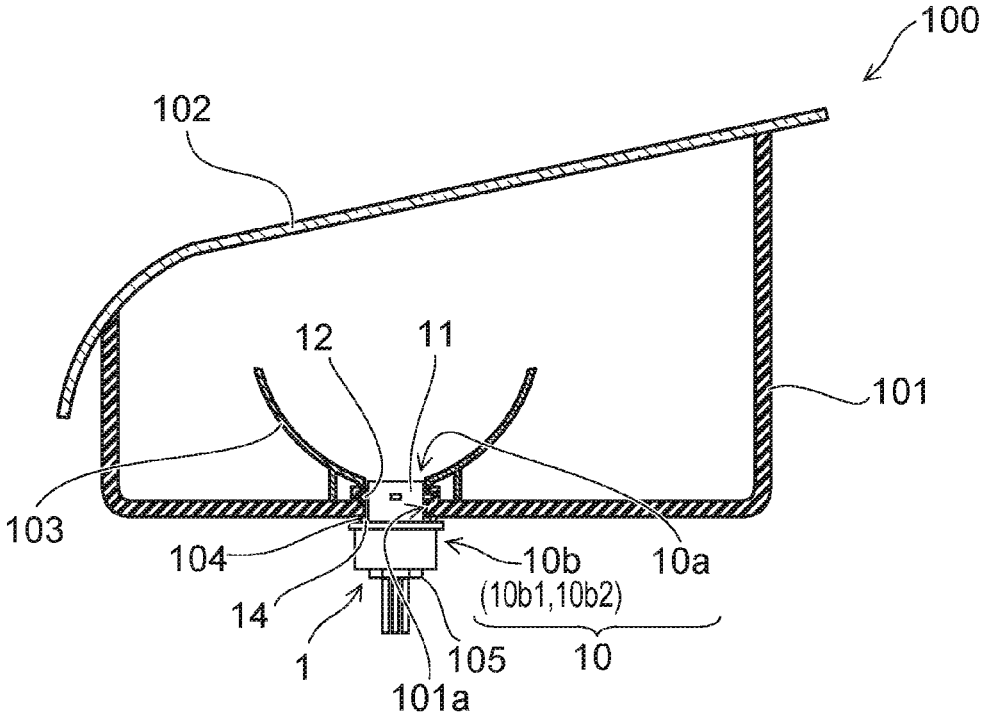
FIG. 7 is a schematic and partial sectional view which exemplifies a lighting tool for vehicle.

FIG. 7 is a schematic and partial sectional view for exemplifying the lighting tool for vehicle 100.

As illustrated in FIG. 7, the lighting device for vehicle 1, a housing 101, a cover 102, an optical element portion 103, a sealing member 104, and the connector 105 are provided in the lighting tool for vehicle 100.

The housing 101 holds the mounting unit 11. The housing 101 is formed in a box shape of which one end portion side is open. The housing 101 can be formed of a resin through which light is not transmitted, or the like, for example. An attaching hole 101*a* into which a portion in which the bayonet 12 of the mounting unit 11 is provided is inserted is provided on a base of the housing 101. A recessed portion into which the bayonet 12 provided in the mounting unit 11 is inserted is provided at the peripheral edge of the attaching hole 101*a*. A case in which the attaching hole 101*a* is directly provided in the housing 101 was exemplified; however, an attaching member including the attaching hole 101*a* may be provided in the housing 101.

When attaching the lighting device for vehicle 1 to the lighting tool for vehicle 100, the portion in which the bayonet 12 of the mounting unit 11 is provided is inserted into the attaching hole 101*a*, and the lighting device for vehicle 1 is rotated. Then, the bayonet 12 is held in a joint portion provided at the peripheral edge of the attaching hole 101*a*. Such an attaching method is referred to as twist-lock.

The cover 102 is provided so as to block the opening of the housing 101. The cover 102 can be formed of a light-transmitting resin, or the like. It is also possible to set the cover 102 to a cover with a function of lens, or the like.

Light output from the lighting device for vehicle 1 is input to the optical element portion 103. The optical element portion 103 performs reflection, diffusion, light guiding, condensing, a formation of a predetermined light distributing pattern, or the like, of light output from the lighting device for vehicle 1.

For example, the optical element portion 103 exemplified in FIG. 7 is a reflector. In this case, the optical element portion 103 reflects light output from the lighting device for vehicle 1, and forms a predetermined light distributing pattern.

The sealing member 104 is provided between the flange 14 and the housing 101. The sealing member 104 can be set to a member formed in an annular shape. The sealing member 104 can be formed of a material with elasticity such as rubber, or a silicone resin.

When attaching the lighting device for vehicle 1 to the lighting tool for vehicle 100, the sealing member 104 is interposed between the flange 14 and the housing 101. For this reason, an inner space of the housing 101 is enclosed by the sealing member 104. In addition, the bayonet 12 is pushed to the housing 101 due to an elastic force of the sealing member 104. For this reason, it is possible to prevent the lighting device for vehicle 1 from escaping from the housing 101.

The connector 105 is fitted to end portions of the plurality of power feeding terminals 31 which are exposed to the inside of the terminal cover 17. A power supply (not illustrated), or the like, is electrically connected to the connector 105. For this reason, the power supply (not illustrated), or the like, and the light emitting element 22 are electrically connected when the connector 105 is fitted to the end portion of the power feeding terminal 31.

In addition, a sealing member (not illustrated) is provided in the connector 105. The sealing member is provided in order to prevent water from entering the inside of the terminal cover 17. When the connector 105 including the sealing member is mounted on the terminal cover 17, the inside of the terminal cover 17 is enclosed so as to be watertight.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A lighting device for vehicle comprising:

a plate-shaped flange;

a placing portion which is provided on a first face of the flange;

a light emitting module which is provided at an end face of the placing portion, and includes a light emitting element;

a plurality of heat radiating fins which are formed in a plate shape, and provided on a second face of the flange on a side opposite to the first face;

a plurality of first protrusion portions which are provided on the second face of the flange in a line, in a direction intersecting a direction in which the plurality of heat radiating fins are aligned; and a second protrusion portion which is provided on the second face of the flange on a side opposite to the plurality of first protrusion portions, by interposing the plurality of heat radiating fins therebetween, wherein at least any one of the plurality of first protrusion portions includes a first recessed portion which is open to an end face on an opposite side from the second face, wherein the second protrusion portion includes a second recessed portion which is open to an end face on an opposite side from the second face, wherein the flange, the plurality of heat radiating fins, the plurality of first protrusion portions, and the second protrusion portion include a high heat conductive resin.

2. The device according to claim 1, wherein the plurality of first protrusion portions are provided in vicinity of a peripheral edge of the flange.

3. The device according to claim 1, wherein the second protrusion portion is provided in the vicinity of a peripheral edge of the flange.

4. The device according to claim 1, wherein at least any one of the plurality of first protrusion portions is formed in a block shape.

5. The device according to claim 1, wherein rigidity of the plurality of first protrusion portions is higher than that of the plurality of heat radiating fins.

6. The device according to claim 1, further comprising:

a terminal cover which is provided between the plurality of first protrusion portions.

7. The device according to claim 6, wherein the plurality of first protrusion portions and the terminal cover are provided in a line, in a direction intersecting a direction in which the plurality of heat radiating fins are aligned.

8. The device according to claim 6, wherein a distance from the second face of the flange to an end face of the first protrusion portion is approximately the same as a distance from the second face of the flange to an end face of the terminal cover.

9. The device according to claim 1, wherein the second protrusion portion is formed in a block shape.

10. The device according to claim 1, wherein rigidity of the second protrusion portion is higher than that of the plurality of heat radiating fins.

11. The device according to claim 1, wherein both sides of columns of the plurality of heat radiating fins are surrounded with the plurality of first protrusion portions and the second protrusion portion.

12. The device according to claim 1, wherein a distance from the second face of the flange to an end face of the second protrusion portion is approximately the same as a distance from the second face of the flange to end faces of the plurality of heat radiating fins.

13. The device according to claim 1, wherein a distance from the second face of the flange to an end face of the first protrusion portion is approximately the same as a distance from the second face of the flange to end faces of the plurality of heat radiating fins.

14. The device according to claim 6, wherein the plurality of first protrusion portions are provided on a peripheral edge side of the flange, compared to a position in which the plurality of heat radiating fins and the terminal cover are provided.

15. The device according to claim 6, wherein the second protrusion portion is provided on a peripheral edge side of the flange, compared to a position in which the plurality of heat radiating fins and the terminal cover are provided.

16. The device according to claim 1, wherein, when a thickness of the heat radiating fin is set to T (mm), a thickness of the first protrusion portion is set to T1 (mm), and a thickness of the second protrusion portion is set to T2 (mm), the following expressions are satisfied:

$$T1 \geq 2 \times T$$

$$T2 \geq 2 \times T.$$

17. A lighting tool for vehicle comprising:

the lighting device for vehicle according to claim 1; and a housing to which the lighting device for vehicle is attached.

* * * * *